US009472900B1

(12) United States Patent
Phillips et al.

(10) Patent No.: US 9,472,900 B1
(45) Date of Patent: Oct. 18, 2016

(54) ELECTRICAL CONNECTOR HAVING RESONANCE CONTROL

(71) Applicant: TYCO ELECTRONICS CORPORATION, Berwyn, PA (US)

(72) Inventors: Michael John Phillips, Camp Hill, PA (US); Thomas Taake de Boer, Hummelstown, PA (US); Bruce Allen Champion, Camp Hill, PA (US); John Joseph Consoli, Harrisburg, PA (US); Sandeep Patel, Middletown, PA (US); Linda Ellen Shields, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/967,585

(22) Filed: Dec. 14, 2015

(51) Int. Cl.
*H01R 13/514* (2006.01)
*H01R 13/6471* (2011.01)
*H01R 12/70* (2011.01)

(52) U.S. Cl.
CPC ..... *H01R 13/6471* (2013.01); *H01R 12/7005* (2013.01)

(58) Field of Classification Search
CPC ..... H01R 13/4362; H01R 13/4223
USPC ..... 439/752, 595, 744, 871
See application file for complete search history.

(56) References Cited

U.S. PATENT DOCUMENTS 6,749,445 B1 * 6/2004 Chen ..... H05K 3/301 439/65
7,371,117 B2 5/2008 Gailus
7,771,233 B2 8/2010 Gailus
8,083,553 B2 12/2011 Manter et al.
8,177,564 B1 5/2012 Ito et al.
8,257,111 B1 * 9/2012 Smutny ..... H01R 13/5208 439/511
8,523,583 B2 9/2013 Ito
9,089,065 B2 * 7/2015 Zhang ..... H01R 12/7005
2006/0046581 A1 * 3/2006 Okamoto ..... H01R 13/4362 439/752
2006/0134975 A1 * 6/2006 Osada ..... H01R 12/712 439/541.5
2009/0130902 A1 * 5/2009 Hall ..... H01R 13/4361 439/595
2014/0127946 A1 5/2014 Ito et al.
2015/0056856 A1 2/2015 Atkinson et al.

OTHER PUBLICATIONS

Zhang, Li and Zhuan; Energy-efficient operation of Heavy Haul Trains in an MPC Framework; IEEE; 6 pages.

* cited by examiner

*Primary Examiner* — Phuongchi T Nguyen

(57) ABSTRACT

An electrical connector includes a housing having a first end and a second end. The housing has a mating slot formed between the first and second ends configured to receive a mating connector having contact pads. A contact array is received in the housing. The contact array includes ground contacts and signal contacts interspersed between corresponding ground contacts. The ground contacts include attachment portions thereon. At least one lossy ground absorber is received in the housing and is coupled to at least one corresponding ground contact. Each lossy ground absorber includes at least one opening. The at least one opening receives the attachment portion of the corresponding ground contact.

20 Claims, 6 Drawing Sheets

ELECTRICAL CONNECTOR HAVING RESONANCE CONTROL

BACKGROUND OF THE INVENTION

The subject matter herein relates generally to electrical connectors having signal and ground contacts.

Some communication systems utilize electrical connectors mounted to a circuit board to interconnect other components for data communication. For example, the electrical connector may include a housing holding contacts terminated to the circuit board. The housing and contacts define a mating interface for mating with a mating connector such as a circuit card, a plug connector, and the like for connecting such mating connector to the circuit board. Some known electrical connectors have performance problems, particularly when transmitting at high data rates. For example, the electrical connectors typically utilize differential pair signal contacts to transfer high speed signals. Ground contacts improve signal integrity. However, electrical performance of known communication connectors, when transmitting the high data rates, is inhibited by noise from cross-talk and by return loss. Such issues are more problematic with small pitch high speed data connectors, which are noisy and exhibit higher than desirable return loss due to the close proximity of signal and ground contacts. Energy from ground contacts on either side of the signal pair may be reflected in the space between the ground contacts and such noise results in reduced connector performance and throughput.

A need remains for a high density, high speed electrical connector having reliable performance.

BRIEF DESCRIPTION OF THE INVENTION

In an embodiment, an electrical connector is provided including a housing having a first end and a second end. The housing has a mating slot formed between the first and second ends configured to receive a mating connector having contact pads. A contact array is received in the housing. The contact array includes ground contacts and signal contacts interspersed between corresponding ground contacts. The ground contacts include attachment portions thereon. At least one lossy ground absorber is received in the housing and is coupled to at least one corresponding ground contact. Each lossy ground absorber includes at least one opening. The at least one opening receives the attachment portion of the corresponding ground contact.

In a further embodiment, an electrical connector is provided including a housing having a first end and a second end. The housing has a mating slot formed between the first and second ends. The mating slot is configured to receive a mating connector having contact pads on a first side and contact pads on a second side. A contact array is received in the housing. The contact array includes a first set of ground contacts and signal contacts arranged at the first end. The contact array includes a second set of ground contacts and signal contacts arranged at the second end. The ground contacts include attachment portions thereon. The ground and signal contacts of the first set are configured to engage the contact pads on the first side of the mating connector. The ground and signal contacts of the second set are configured to engage the contact pads on the second side of the mating connector. At least one lossy ground absorber is received in the housing and extends at least partially between the first and second ends. Each lossy ground absorber interconnects at least one of the ground contacts of the first set and at least one of the ground contacts of the second set. Each lossy ground absorber includes a first absorber end having a first opening and a second absorber end having a second opening. The first opening receives the attachment portion of the corresponding ground contact of the first set and the second opening receives the attachment portion of the corresponding ground contact of the second set.

In a further embodiment, an electrical connector is provided including a housing having a first end and a second end, a front end and a rear end, and a first side and a second side between the first and second ends. The housing has a mating slot open at the front end and positioned between the first and second ends and between the first and second sides. The mating slot is configured to receive a mating connector having contact pads. A contact array is received in the housing. The contact array includes ground contacts and signal contacts interspersed along a contact row between the mating slot and the first end. The ground contacts include attachment portions thereon. A lossy ground absorber is received in the housing at the first end. The lossy ground absorber extends along the contact row across at least two signal contacts and at least two ground contacts. The lossy ground absorber includes at least two openings receiving the attachment portions of the corresponding ground contacts. The lossy ground absorber interconnects at least two of the ground contacts.

DETAILED DESCRIPTION OF THE INVENTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a receptacle connector that is mounted to and electrically coupled to a circuit board. The receptacle connector is configured to mate with a pluggable input/output (I/O) connector during a mating operation. It should be understood, however, that the inventive subject matter set forth herein may be applicable in other types of electrical connectors. In various embodiments, the electrical connectors provide lossy ground absorbers to provide resonance control. Moreover, in various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps.

In various embodiments described and/or illustrated herein, the electrical connectors include signal and ground conductors that are positioned relative to each other to form a pattern or array that includes one or more rows (or columns). The signal and ground conductors of a single row (or column) may be substantially co-planar. The signal conductors form signal pairs in which each signal pair is flanked on both sides by ground conductors. The ground conductors electrically separate the signal pairs to reduce electromagnetic interference or crosstalk and to provide a reliable ground return path. The signal and ground conductors in a single row are patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors.

Figure 1:
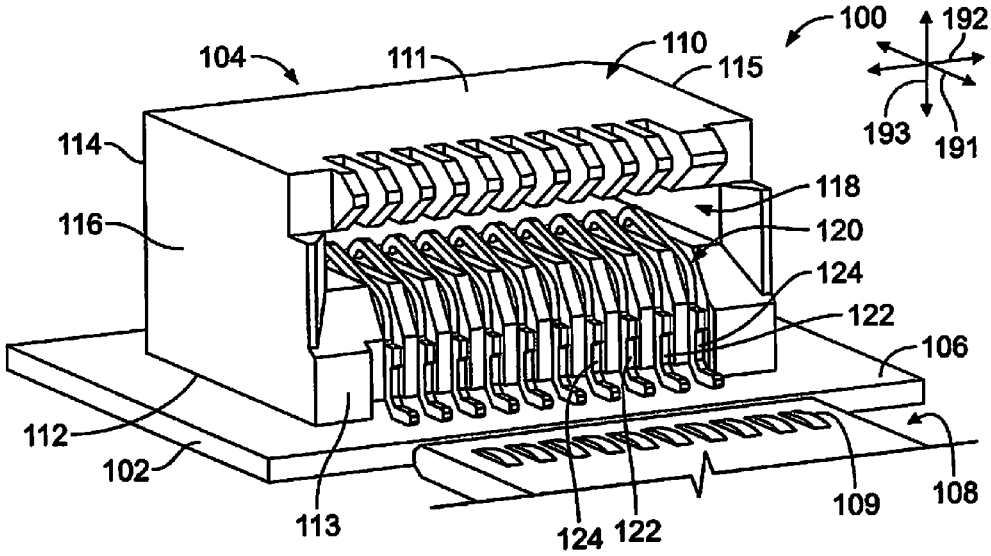
FIG. 1 is a front perspective view of a circuit board assembly formed in accordance with an embodiment.
Figure 2:
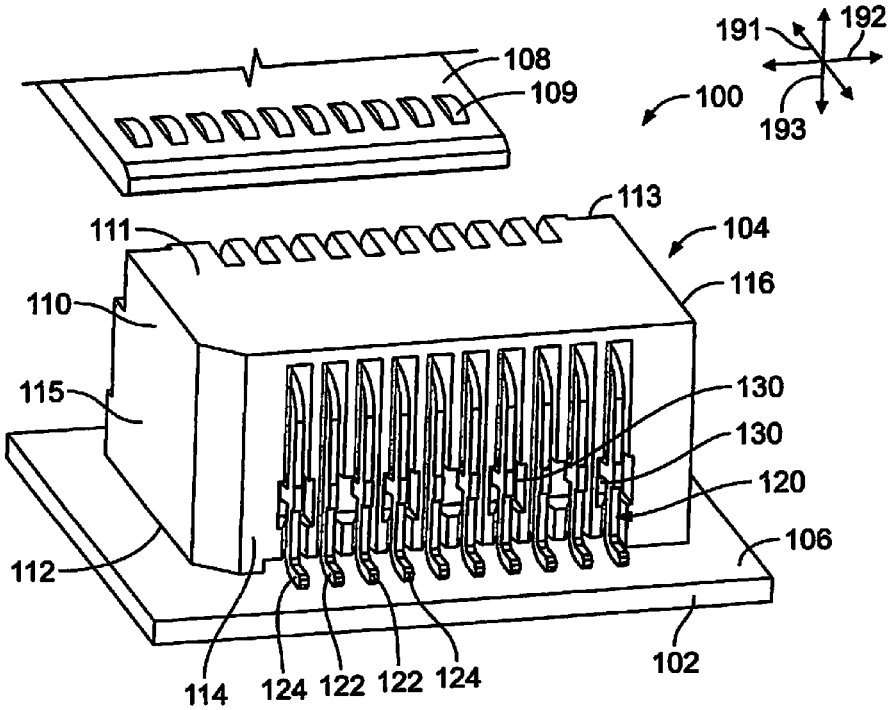
FIG. 2 is a rear perspective view of the circuit board assembly.

FIG. 1 is a front perspective view of a circuit board assembly 100 formed in accordance with an embodiment. FIG. 2 is a rear perspective view of the circuit board assembly 100. The circuit board assembly 100 includes a circuit board 102 and an electrical connector 104 that is mounted onto a board surface 106 of the circuit board 102. A mating connector 108 is configured to be mated with the electrical connector 104. In the illustrated embodiment, the mating connector 108 is or includes a circuit card, such as a paddle card style printed circuit board; however other types of mating components may be used in alternative embodiments. For example, the mating connector 108 may be a plug connector. The mating connector 108 includes contact pads 109 on one or both surfaces of the mating connector 108 configured to be electrically connected to corresponding contacts of the electrical connector 104.

The circuit board assembly 100 is oriented with respect to mutually perpendicular axes, including a mating axis 191, a lateral axis 192, and a vertical or elevation axis 193. In FIG. 1, the vertical axis 193 extends parallel to a gravitational force direction. It should be understood, however, that embodiments described herein are not limited to having a particular orientation with respect to gravity. For example, the lateral axis 192 or the mating axis 191 may extend parallel to the gravitational force direction in other embodiments. The mating connector 108 is mated with the electrical connector 104 along that mating axis 191.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) connector, such as or including the mating connector 108. The electrical connectors 104 and mating connectors 108 may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 104 described herein may be high-speed electrical connectors that are capable of transmitting data at a rate of at least about five (5) gigabits per second (Gbps). In some embodiments, the electrical connectors 104 described herein may be high-speed electrical connectors that are capable of transmitting data at a rate of at least about 10 Gbps, or more.

Although not shown, each of the electrical connectors 104 may be positioned within a receptacle cage. The receptacle cage may be configured to receive one or more of the mating connectors 108 during a mating operation and direct the mating connector 108 toward the corresponding electrical connector 104. The circuit board assembly 100 may also include other devices that are communicatively coupled to the electrical connectors 104 through the circuit board 102. The electrical connectors 104 may be positioned proximate to one edge of the circuit board.

The electrical connector 104 includes a housing 110 having a plurality of walls, including a first end 111, a second end 112, a front end 113, a rear end 114, a first side 115 and a second side 116. The housing 110 may include greater or fewer walls in alternative embodiments. The housing sides 115, 116 extend between the front and rear ends 113, 114 and the first and second ends 111, 112. The front end 113 and the rear end 114 face in opposite directions along the mating axis 191. The first and second sides 115, 116 face in opposite directions along the lateral axis 192. The first and second ends 111, 112 face in opposite directions along the vertical axis 193. The housing 110 extends a height between the first end 111 and the second end 112. The housing 110 extends a width between the front end 113 and the rear end 114. The housing 110 extends a length between the first and second sides 115, 116.

In the illustrated embodiment, the first end 111 defines a top end and may be referred to hereinafter as a top end 111 and the second end 112 defines a bottom end and may be referred to hereinafter as a bottom end 112. The bottom end 112 faces the board surface 106 and may be mounted to or engage the board surface 106. The top end 111 faces away from the circuit board 102 and may have the greatest elevation of the housing walls with respect to the board surface 106.

In the illustrated embodiment of FIG. 1, the electrical connector 104 is a right-angle connector such that the front end 113, which is the receiving side, and the bottom end 112, which is the mounting side, are oriented substantially perpendicular or orthogonal to each other. More specifically, the front end 113 faces in a receiving direction along the mating axis 191 and the mounting side faces in a mounting direction along the vertical axis 193. In other embodiments, the receiving side and the mounting side may face in different directions than those shown in FIG. 1. For example, the top end 111 may define the receiving side that receives the mating connector 108 such that the electrical connector 104 is a vertical connector rather than a right-angle connector.

The housing 110 includes a mating slot 118 that is sized and shaped to receive a portion of the mating connector 108. For example, in the illustrated embodiment, the mating slot 118 is sized and shaped to receive the mating connector 108, including the contact pads 109, such as an edge of the circuit card or other type of connector. The mating slot 118 is positioned between the first and second ends 111, 112. The mating slot 118 is open at the front end 113 with an upper portion of the housing 110 positioned between the mating slot 118 and the first end 111 and a lower portion of the housing 110 positioned between the mating slot 118 and the second end 112.

The electrical connector 104 includes a contact array 120 received in the housing 110. The contact array 120 includes signal contacts 122 and ground contacts 124 that extend into the mating slot 118 for mating with corresponding contact pads 109. The signal and ground contacts 122, 124 also extend to the bottom end 112 for mounting to the circuit board 102. For example, ends of the signal and ground contacts 122, 124 may be surface mounted (for example, soldered) to the circuit board 102 or press-fit into plated vias in the circuit board 102 for mechanical and electrical connection to the circuit board 102. The contact array 120 is arranged in the housing 110 such that the signal and ground contacts 122, 124 are arranged in at least one row of contacts. In an exemplary embodiment, the signal and ground contacts 122, 124 are arranged in a first row and a second row. For example, the signal and ground contacts 122, 124 are arranged in an upper row and a lower row generally at the top end 111 and the bottom end 112, respectively (for example, arranged between the mating slot 118 and the top end 111 and between the mating slot 118 and the bottom end 112, respectively). The signal and ground contacts 122, 124 may be arranged in a front row and a rear row generally at the front end 113 and the rear end 114, respectively. In an exemplary embodiment, the first row defines both an upper row and a rear row as the corresponding signal and ground contacts 122, 124 are arranged both along the top end 111 and the rear end 114 and the second row defines both a lower row and a front row as the corresponding signal and ground contacts 122, 124 are arranged both along the bottom end 112 and the front end 113.

The signal and ground contacts 122, 124 may be arranged to form a plurality of ground-signal-signal-ground (GSSG) sub-arrays in which each pair of signal contacts 122 is located between two ground contacts 124. The electrical connector 104 may also include at least one lossy ground absorber 130 (FIG. 2). The lossy ground absorber 130 may be a single piece or may be multiple pieces distributed throughout the housing 110 in select locations. Each of the lossy ground absorbers 130 is configured to absorb at least some electrical resonance that propagates along the current path defined by the ground contacts 124 and/or at least some electrical resonance that propagates along the signal path defined by the corresponding signal contacts 122. The lossy ground absorber 130 may control or limit undesirable resonances that occur within the ground contacts 124 during operation of the electrical connector 104. The lossy ground absorber 130 may effectively reduce the frequency of energy resonating within the housing 110. The housing 110 is manufactured from a low loss dielectric material, such as a plastic material. The low loss dielectric material has dielectric properties that have relatively little variation with frequency. Electrical performance of the communication connector 104 is enhanced by the inclusion of the lossy material in the lossy ground absorbers 130. For example, at various data rates, including high data rates, return loss is inhibited by the lossy material. For example, the return loss of the small pitch, high speed data of the signal contacts 122 due to the close proximity of signal and ground contacts 122, 124 is reduced by the lossy ground absorbers 130. For example, energy from the ground contacts 124 on either side of the signal pair reflected in the space between the ground contacts 124 is absorbed, and thus connector performance and throughput is enhanced.

The lossy ground absorber 130 may be provided at the rear end 114 to couple to one or more ground contacts 124 in the rear row. The lossy ground absorber 130 may be provided at the front end 113 to couple to one or more ground contacts 124 in the front row. Optionally, the lossy ground absorber 130 may extend width-wise between the front end 113 and the rear end 114 to couple to ground contacts 124 in both the front and rear rows. The lossy ground absorber 130 may be provided at the top end 111 to couple to one or more ground contacts 124 in the upper row. The lossy ground absorber 130 may be provided at the bottom end 112 to couple to one or more ground contacts 124 in the lower row and/or the upper row. Optionally, the lossy ground absorber 130 may extend length-wise to couple to multiple ground contacts 124 in the first row, in the second row, or in both the first and second rows. For example, the lossy ground absorber 130 may extend from one ground contact 124 across both signal contacts of the pair to the other ground contact 124 of the GSSG sub-array. Optionally, the lossy ground absorber 130 may extend across and couple to ground contacts 124 of multiple GSSG sub-arrays.

In an exemplary embodiment, the lossy ground absorber 130 includes lossy material configured to absorb at least some electrical resonance that propagates along the current paths defined by the signal contacts 122 and/or the ground contacts 124 through the electrical connector 104. For example, the lossy material may be embedded in the housing 110. The lossy material has dielectric properties that vary with frequency. The lossy material provides lossy conductivity and/or magnetic lossiness through a portion of the electrical connector 104. The lossy material is able to conduct electrical energy, but with at least some loss. The lossy material is less conductive than conductive material, such as the conductive material of the contacts 122, 124. The lossy material may be designed to provide electrical loss in a certain, targeted frequency range, such as by selection of the lossy material, placement of the lossy material, proximity of the lossy material to the ground paths and the signal paths, and the like. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connector housings. The thermoplastic material may be molded, such as molding of the lossy ground absorber 130 into the desired shape and/or location. However, many alternative forms of binder materials may be used. Curable materials, such as epoxies, can serve as a binder. Alternatively, materials such as thermosetting resins or adhesives may be used.

Figure 3:
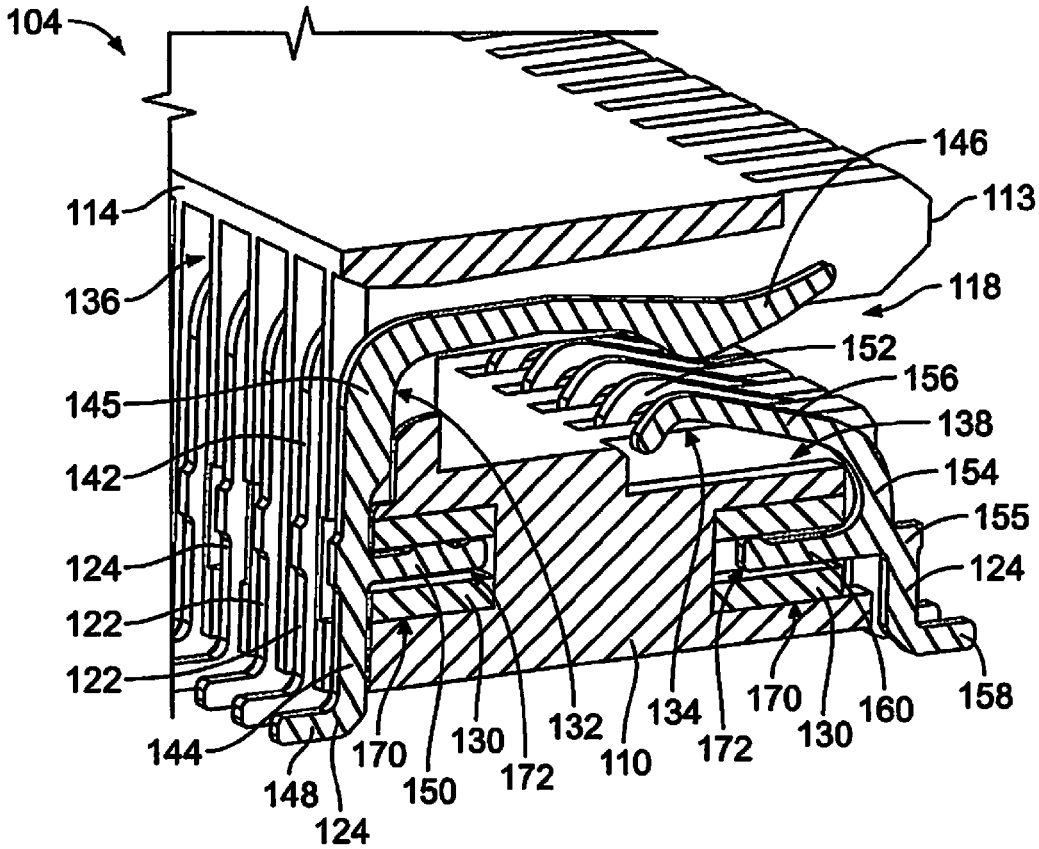
FIG. 3 is a partial sectional view of an electrical connector of the circuit board assembly formed in accordance with an exemplary embodiment.

FIG. 3 is a partial sectional view of the electrical connector 104 formed in accordance with an exemplary embodiment. The mating slot 118 is shown in the housing 110 open at the front end 113. FIG. 3 shows first and second rows 132, 134 of signal and ground contacts 122, 124 arranged in the housing 110 on opposite sides of the mating slot 118.

The signal and ground contacts 122, 124 of the first row 132 are received in first contact channels 136 in the housing 110, and the signal and ground contacts 122, 124 of the second row 134 are received in second contact channels 138. The first contact channels 136 are open at the rear end 114 and the signal and ground contacts 122, 124 are loaded into the first contact channels 136 through the rear end 114. The second contact channels 138 are open at the front end 113 and the signal and ground contacts 122, 124 are loaded into the second contact channels 138 through the front end 113.

The signal and ground contacts may be referred to generally as signal contacts 122 and ground contacts 124. The signal contacts in the first row 132 may also be identified specifically as upper or rear signal contacts 142, and the ground contacts in the first row 132 may also be identified specifically as upper or rear ground contacts 144. The signal contacts in the second row 134 may also be identified specifically as lower or front signal contacts 152, and the ground contacts in the second row 134 may also be identified specifically as lower or front ground contacts 154. The upper and lower signal contacts 142, 152 are shaped differently. The upper and lower ground contacts 144, 154 are shaped differently. Optionally, the upper signal contacts 142 and the upper ground contacts 144 may be shaped similar, while the lower signal contacts 152 and the lower ground contacts 154 may be shaped similar.

The signal contacts 142 and the ground contacts 144 each have a main body 145 extending between a mating end 146 and a terminating end 148. The contacts 142, 144 may have a deflectable mating beam at the mating end 146 for mating with the contact pads 109 of the mating connector 108 (both shown in FIG. 1). The contacts 142, 144 may have a solder tail at the terminating end 148 for surface mounting to the circuit board 102 (shown in FIG. 1). Other types of mating or terminating portions may be provided in alternative embodiments, such as a compliant pin at the terminating end 148.

In an exemplary embodiment, the signal contacts 142 and/or the ground contacts 144 include an attachment portion 150 on or extending from the main body 145. In an exemplary embodiment, the attachment portion 150 may be a tab extending from the main body 145 and may be referred to hereinafter as an attachment tab 150; however the attachment portion 150 may have other shapes or features in alternative embodiments. For example, the attachment portion 150 may be a protrusion, a bump, a depression, a bend or fold in the body, a straight segment of the main body 145 or any other feature having any other shape.

The attachment tabs 150 may be used to secure the signal contacts 142 and/or the ground contacts 144 in the housing 110. The attachment tabs 150 may include barbs, lances, or other features shaped to secure the contacts 142, 144 to the housing 110. In the illustrated embodiment, the attachment tabs 150 extend forward from the corresponding main body 145. In the illustrated embodiment, the attachment tab 150 of the ground contact 144 extends into the corresponding lossy ground absorber 130 to connect the ground contact 144 to the lossy ground absorber 130. Optionally, the signal contacts 142 may be devoid of attachment tabs 150. The signal contacts 142 and/or the ground contacts 144 may additionally or alternatively be secured to the housing 110 by an interference fit between the contacts 142, 144 and the walls of the housing 110 defining the contact channels 136, 138. Portions of the contacts 142, 144 may be enlarged and/or include features such as barbs or lances that dig into the plastic of the housing 110 to secure the contacts 142, 144 in the housing 110.

The signal contacts 152 and the ground contacts 154 each have a main body 155 extending between a mating end 156 and a terminating end 158. The contacts 152, 154 may have a deflectable mating beam at the mating end 156 for mating with the contact pads 109 on the bottom surface of the mating connector 108 (shown in FIG. 1). The contacts 152, 154 may have a solder tail at the terminating end 158 for surface mounting to the circuit board 102 (shown in FIG. 1). Other types of mating or terminating portions may be provided in alternative embodiments, such as a compliant pin at the terminating end 158.

In an exemplary embodiment, the signal contacts 152 and/or the ground contacts 154 include an attachment tab 160 extending from the main body 155. The attachment tabs 160 may be used to secure the signal contacts 152 and/or the ground contacts 154 in the housing 110. The attachment tabs 160 may include barbs, lances, or other features shaped to secure the contacts 152, 154 to the housing 110. In the illustrated embodiment, the attachment tabs 160 extend rearward from the corresponding main body 155. In the illustrated embodiment, the attachment tab 160 of the ground contact 154 extends into the corresponding lossy ground absorber 130 to connect the ground contact 154 to the lossy ground absorber 130. Optionally, the signal contacts 152 may be devoid of attachment tabs 160. The signal contacts 152 and/or the ground contacts 154 may additionally or alternatively be secured to the housing 110 by an interference fit between the contacts 152, 154 and the walls of the housing 110 defining the contact channels 136, 138. Portions of the contacts 152, 154 may be enlarged and/or include features such as barbs or lances that dig into the plastic of the housing 110 to secure the contacts 152, 154 in the housing 110.

The housing 110 includes pockets 170 that receive corresponding lossy ground absorbers 130. In the illustrated embodiment, the housing 110 includes a plurality of individual pockets 170 that receive corresponding lossy ground absorbers 130 connected to corresponding individual ground contacts 144, 154. Alternatively, the housing 110 may include a single pocket 170 that receives a single lossy ground absorber 130 connected to multiple ground contacts 144 and/or 154. In an exemplary embodiment, the lossy ground absorbers 130 are molded in the pockets 170. For example, the lossy ground absorbers 130 may be co-molded with the housing 110 in a multi-stage molding process, such as a two-shot molding process, where the housing 110 and the lossy ground absorbers 130 are molded from different materials, such as a low loss plastic material and a lossy material, respectively. The housing 110 may be initially molded to define the pockets 170 and then the lossy ground absorbers 130 may be molded into the pockets 170. Alternatively, the lossy ground absorbers 130 may be initially molded and then the housing 110 may be molded around the lossy ground absorbers 130. In other alternative embodiments, the housing 110 and the lossy ground absorbers 130 may be separately molded and then the lossy ground absorbers 130 may be picked and placed into the corresponding pockets 170.

In the illustrated embodiment, some of the pockets 170 are open at the rear end 114 while other pockets 170 are open at the front end 113 to receive corresponding lossy ground absorbers 130 therein. The lossy ground absorbers 130 at the rear end 114 are separate from the lossy ground absorbers 130 at the front end 113. The lossy ground absorbers 130 at the rear end 114 include openings 172 that receive attachment tabs 150 of the ground contacts 144 in the first row 132. The lossy ground absorbers 130 at the front end 113 include similar openings 172 that receive attachment tabs 160 of the ground contacts 154 in the second row 134. Optionally, the openings 172 are sized and shaped to provide an interference fit for the corresponding attachment tabs 150, 160.

The lossy ground absorbers 130 extend horizontally along portions of the attachment tabs 150, 160. The lossy ground absorbers 130 extend vertically along portions of the main bodies 145, 155. As such, the lossy ground absorbers 130 are positioned relative to the ground contacts 144, 154 to absorb at least some electrical resonance that propagates along the current paths defined by the ground contacts 144, 154 through the electrical connector 104. The lossy ground absorbers 130 are positioned relative to the signal contacts 142, 152, such as near but not physically engaged with the signal contacts 142, 152, to absorb at least some electrical resonance that propagates along the current paths defined by the signal contacts 142, 152 through the electrical connector 104.

Figure 4:
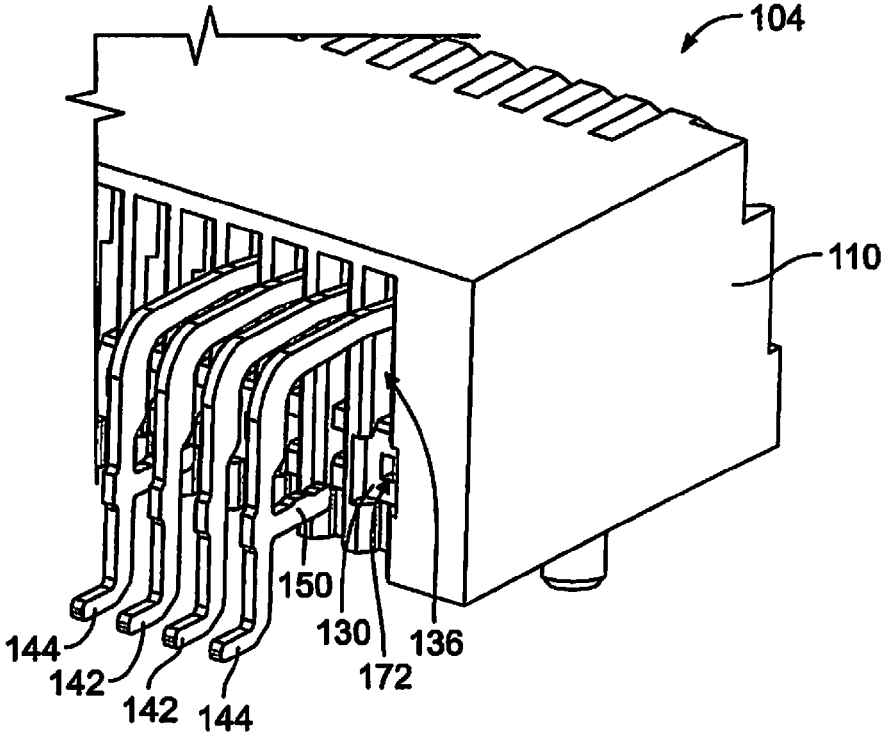
FIG. 4 is a rear perspective view of a portion of the electrical connector.

FIG. 4 is a rear perspective view of a portion of the electrical connector 104 showing a GSSG sub-array of signal and ground contacts 142, 144 being loaded into the housing 110. The individual lossy ground absorbers 130 are aligned with corresponding contact channels 136 that receive the ground contacts 144. The attachment tabs 150 of the ground contacts 144 are loaded into corresponding openings 172 in the lossy ground absorbers 130. In the illustrated embodiment, the signal contacts 142 do not include attachment tabs. However, in other various embodiments, the signal contacts 142 may include attachment tabs 150 that are received in openings in the housing 110 rather than being received in the lossy ground absorbers 130 such that the signal contacts 142 do not directly engage the lossy ground absorbers 130.

Figure 5:
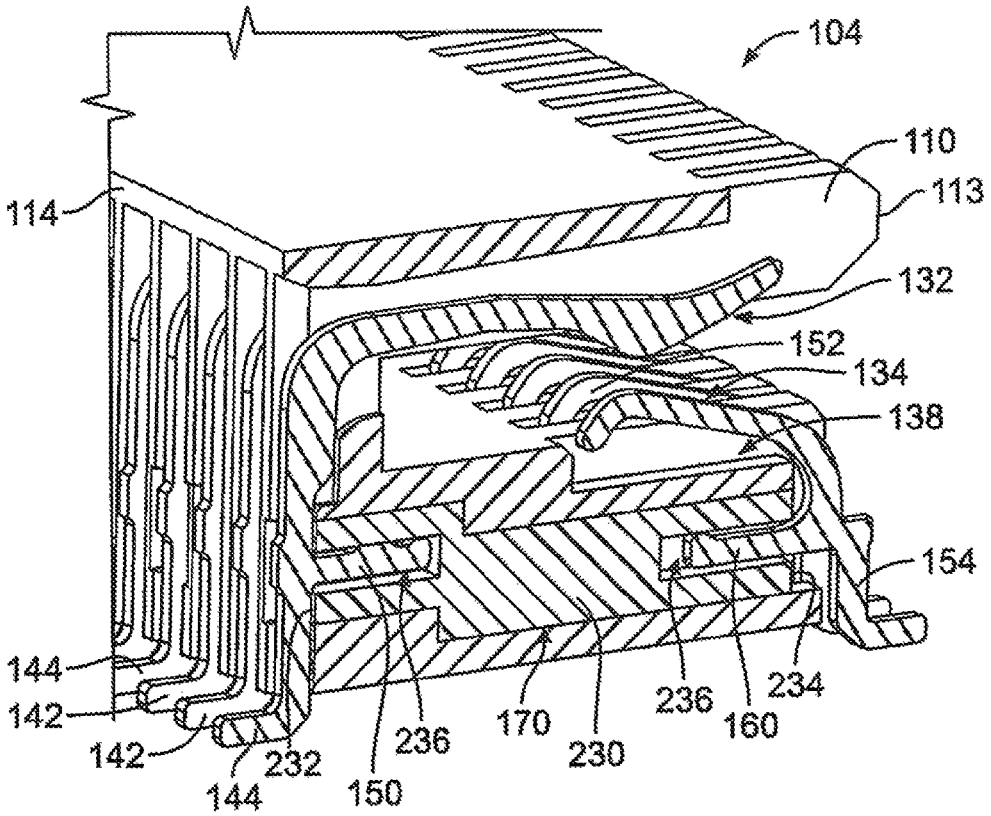
FIG. 5 is a partial sectional view of the electrical connector showing a lossy ground absorber in accordance with an exemplary embodiment.
Figure 6:
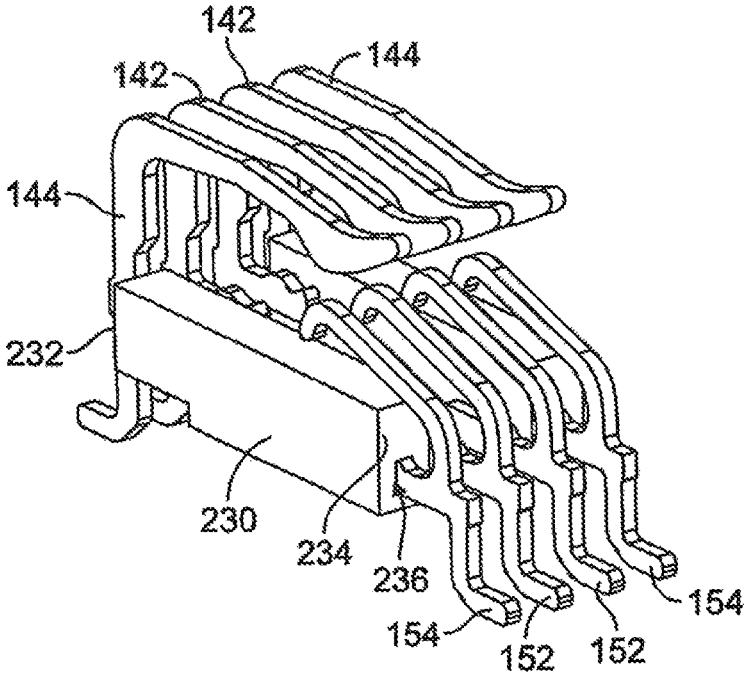
FIG. 6 is a front perspective view of a portion of the electrical connector and lossy ground absorber shown in FIG. 5.

FIG. 5 is a partial sectional view of the electrical connector 104 showing a lossy ground absorber 230 in accordance with an exemplary embodiment. FIG. 6 is a front perspective view of a portion of the electrical connector 104 showing a GSSG sub-array of signal and ground contacts 142, 144 and a GSSG sub-array of signal and ground contacts 152, 154 and corresponding lossy ground absorbers 230. The lossy ground absorbers 230 are similar to the lossy ground absorbers 130 (shown in FIG. 3), but may be shaped differently. For example, the lossy ground absorber 230 in essence replaces multiple lossy ground absorbers 130 front-to-rear within the housing 110 with a single lossy ground absorber 230.

The lossy ground absorbers 230 extend widthwise within the housing 110 at least partially between the rear end 114 and the front end 113. Optionally, the lossy ground absorbers 230 extend a majority of the width between the rear end 114 and the front end 113. The lossy ground absorbers 230 tie multiple ground contacts 144, 154 together using the lossy material of the lossy ground absorbers 230. In an exemplary embodiment, the lossy ground absorbers 230 may be molded or inserted into the pocket 170 open at the rear end 114 of the housing 110. The front end 113 does not necessarily need to include any pockets. The contact channels 138 that receive the ground contacts 154 may be narrower as a result.

The lossy ground absorbers 230 include a first absorber end 232 and a second absorber end 234. The first and second absorber ends 232, 234 both include openings 236. The first opening 236 at the first absorber end 232 receives the attachment tab 150 of the rear ground contact 144 whereas the second opening 236 at the second absorber end 234 receives the attachment tab 160 of the front ground contact 154. Each lossy ground absorber 230 interconnects one of the ground contacts 144 in the first row 132 with one of the ground contacts 154 in the second row 134. The lossy ground absorbers 230 position the lossy material in the space between the first and second sets of ground contacts 144, 154. The lossy ground absorbers 230 absorb at least some electrical resonance that propagates along the current paths defined by the ground contacts 144, 154 through the electrical connector 104. The lossy ground absorbers 230 occupy a greater volume of the space within the housing 110 then the lossy ground absorbers 130. The lossy ground absorbers 230 isolate the signal contacts 142, 152 from signal contacts in a neighboring sub-array. Leak paths between the first absorber end 232 and the second absorber end 234 are eliminated.

Figure 7:
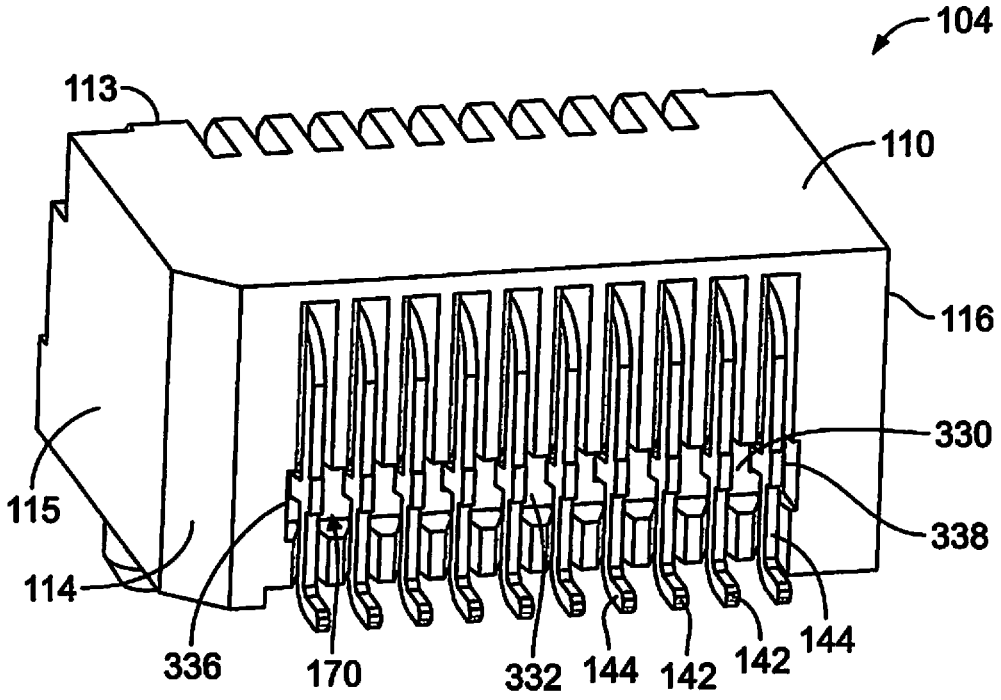
FIG. 7 is a rear perspective view of the electrical connector showing a lossy ground absorber in accordance with an exemplary embodiment.
Figure 8:
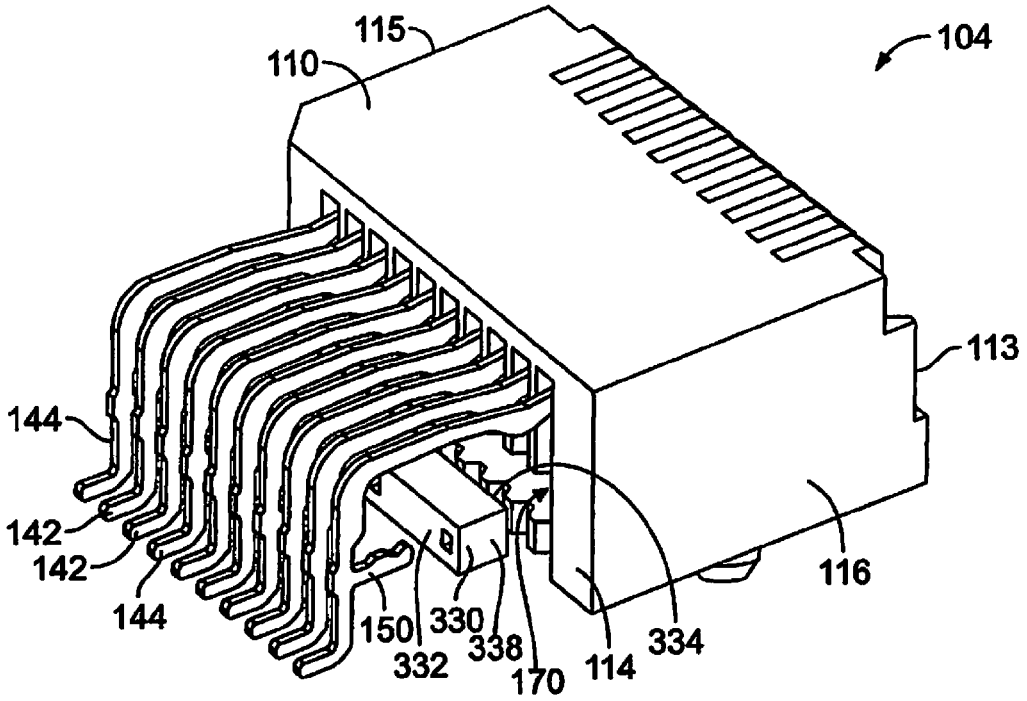
FIG. 8 is an exploded view of the electrical connector and lossy ground absorber shown in FIG. 7.
Figure 9:
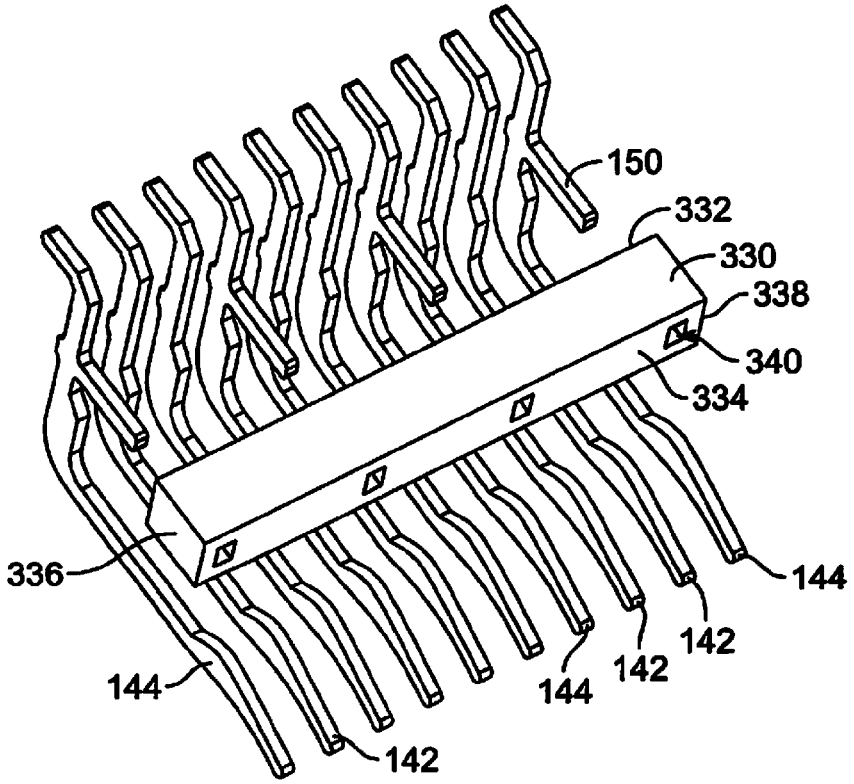
FIG. 9 is a bottom perspective view of a portion of the electrical connector and lossy ground absorber shown in FIG. 7.

FIG. 7 is a rear perspective view of the electrical connector 104 showing a lossy ground absorber 330 in accordance with an exemplary embodiment. FIG. 8 is an exploded view of the electrical connector 104 showing the lossy ground absorber 330 and contacts 142, 144. FIG. 9 is a bottom perspective view of a portion of the electrical connector 104 showing GSSG sub-arrays of signal and ground contacts 142, 144 and corresponding lossy ground absorber 330. The lossy ground absorber 330 is similar to the lossy ground absorbers 130 (shown in FIG. 3) and the lossy ground absorbers 230 (shown in FIG. 6) but may be shaped differently. For example, the lossy ground absorber 330 in essence replaces multiple lossy ground absorbers 130 side-to-side within the housing 110 with a single lossy ground absorber 330.

The lossy ground absorber 330 extends lengthwise within the housing 110 at least partially between the first side 115 and the second side 116. The lossy ground absorber 330 ties multiple ground contacts 144 together using the lossy material of the lossy ground absorber 330. Optionally, the lossy ground absorber 330 extends a majority of the length between the first side 115 and the second side 116. In an exemplary embodiment, the lossy ground absorber 330 may be molded or inserted into the corresponding pocket 170 open at the rear end 114 of the housing 110. A similar lossy ground absorber 330 may be used at the front end 113 for the ground contacts 154 (shown in FIG. 3).

The lossy ground absorber 330 includes a first absorber end 332 and a second absorber end 334 and a first absorber side 336 and a second absorber side 338. The first absorber end 332 includes openings 340 at various positions across the length thereof between the sides 336, 338. The openings 340 receive the attachment tabs 150 of the ground contacts 144. The lossy ground absorber 330 spans across one or more GSSG sub-arrays, and in the illustrated embodiment, spans across all of the GSSG sub-arrays. The lossy ground absorber 330 interconnects multiple ground contacts 144. The lossy ground absorber 330 spans across the pair(s) of signal contacts 142, such as below the signal contacts 142. The lossy material of the lossy ground absorber 330 is positioned in the space below the signal contacts 142 to absorb at least some electrical resonance that propagates along the current paths defined by the ground contacts 144 and/or the current paths defined by the signal contacts 142. The lossy ground absorber 330 occupies a greater volume of space within the housing 110 then the lossy ground absorbers 130.

Figure 10:
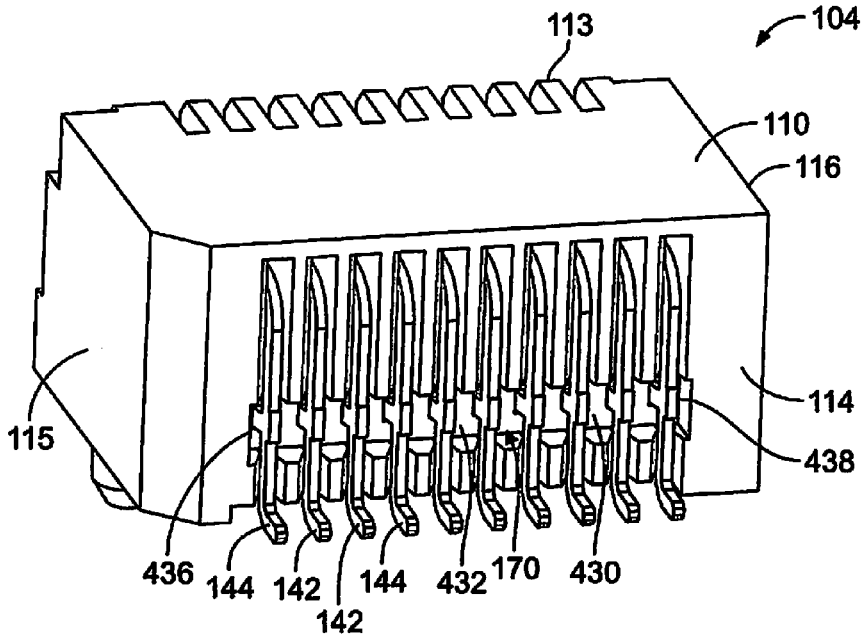
FIG. 10 is a rear perspective view of the electrical connector showing a lossy ground absorber in accordance with an exemplary embodiment.
Figure 11:
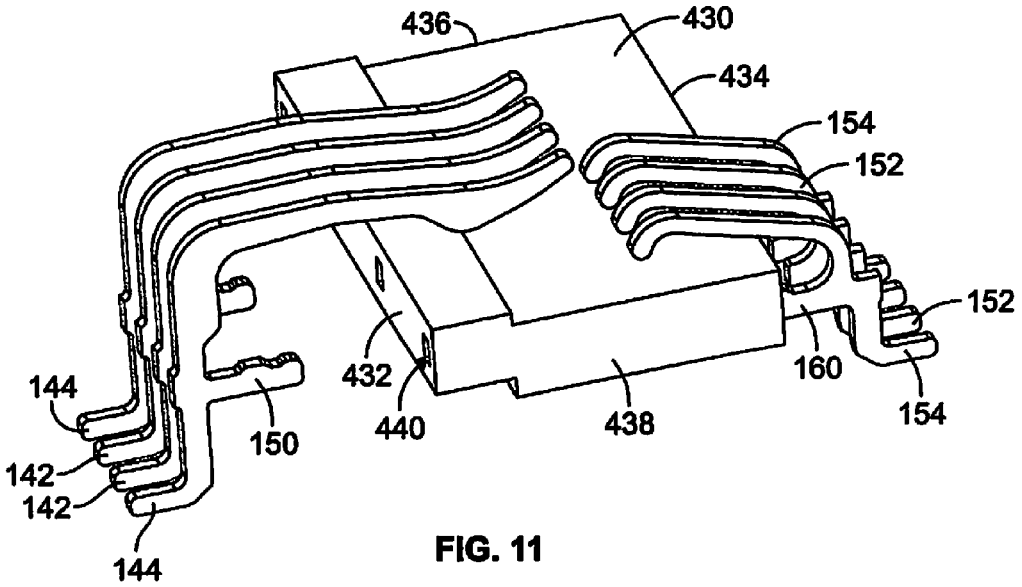
FIG. 11 is a perspective view of a portion of the electrical connector and lossy ground absorber shown in FIG. 10.

FIG. 10 is a rear perspective view of the electrical connector 104 showing a lossy ground absorber 430 in accordance with an exemplary embodiment. FIG. 11 is a perspective view of a portion of the electrical connector 104 without the housing 110 showing a GSSG sub-array of signal and ground contacts 142, 144 and a GSSG sub-array of signal and ground contacts 152, 154 and a corresponding lossy ground absorber 430. The lossy ground absorber 430 is similar to the lossy ground absorbers 130 (shown in FIG. 4), the lossy ground absorbers 230 (shown in FIG. 6) and the lossy ground absorber 330 but may be shaped differently. For example, the lossy ground absorber 430 in essence replaces multiple lossy ground absorbers 130 front-to-rear and side-to-side within the housing 110 with a single lossy ground absorber 430.

The lossy ground absorber 430 extends widthwise and lengthwise within the housing 110 at least partially between the front end 113 and the rear end 114 and at least partially between the first side 115 and the second side 116. The lossy ground absorber 430 ties multiple ground contacts 144, 154 together using the lossy material of the lossy ground absorber 430. Optionally, the lossy ground absorber 430 extends a majority of the width between the front end 113 and the rear end 114 and extends a majority of the length between the first side 115 and the second side 116. In an exemplary embodiment, the lossy ground absorber 430 may be molded or inserted into the pocket 170 open at the rear end 114 of the housing 110.

The lossy ground absorber 430 includes a first absorber end 432 and a second absorber end 434 and a first absorber side 436 and a second absorber side 438. Both the first and second absorber ends 432, 434 include openings 440 at various positions across the length thereof. The openings 440 receive the attachment tabs 150, 160 of the ground contacts 144, 154. The lossy ground absorber 430 spans across one or more GSSG sub-arrays, and in the illustrated embodiment, spans across all of the GSSG sub-arrays. The lossy ground absorber 430 interconnects multiple ground contacts 144, 154. The lossy ground absorber 430 spans across the pair(s) of signal contacts 142, 152, such as below the signal contacts 142, 152. The lossy material of the lossy ground absorber 430 is positioned in the space below the signal contacts 142, 152 to absorb at least some electrical resonance that propagates along the current paths defined by the ground contacts 144, 154 and/or the current paths defined by the signal contacts 142, 152. The lossy ground absorber 430 occupies a greater volume of space within the housing 110 then the lossy ground absorbers 130.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a first end and a second end, the housing having a mating slot formed between the first and second ends, the mating slot being configured to receive a mating connector having contact pads;

a contact array received in the housing, the contact array including ground contacts and signal contacts interspersed between corresponding ground contacts, the ground contacts including attachment portions thereon; and at least one lossy ground absorber received in the housing and being coupled to at least one corresponding ground contact, each lossy ground absorber including at least one opening, the at least one opening receiving the attachment portion of the corresponding ground contact.

2. The electrical connector of claim 1, wherein the attachment portion is press-fit in the corresponding opening.

3. The electrical connector of claim 1, wherein the ground contact is held in the opening by an interference fit.

4. The electrical connector of claim 1, wherein the housing includes at least one pocket each receiving a corresponding lossy ground absorber such that the at least one lossy ground absorber is entirely contained within the housing.

5. The electrical connector of claim 1, wherein the housing and the at least one lossy ground absorber are co-molded.

6. The electrical connector of claim 1, wherein the housing is manufactured from a low loss dielectric material and the at least one lossy ground absorber is manufactured from lossy material having conductive particles in a dielectric binder material, the lossy ground absorber absorbing electrical resonance propagating through the housing.

7. The electrical connector of claim 1, wherein each lossy ground absorber is coupled to at least two ground contacts.

8. The electrical connector of claim 1, wherein each lossy ground absorber is coupled to all of the ground contacts.

9. The electrical connector of claim 1, wherein the ground contacts are arranged in a row with a pair of signal contacts between each of the ground contacts, the at least one lossy ground absorber spanning between the ground contacts across the pair of signal contacts.

10. The electrical connector of claim 1, wherein the contact array includes a first set of ground and signal contacts arranged at the first end configured to engage contact pads on a first side of the mating connector, and wherein the contact array includes a second set of ground and signal contacts arranged at the second end configured to engage contact pads on a second side of the mating connector, the lossy ground absorber interconnecting at least one of the ground contacts of the first set and at least one of the ground contacts of the second set.

11. The electrical connector of claim 1, wherein the at least one lossy ground absorber extends widthwise between a front end and a rear end of the housing to interconnect at least one ground contact at the front end with at least one ground contact at the rear end.

12. The electrical connector of claim 1, wherein the at least one lossy ground absorber extends lengthwise between a first side and a second side of the housing to interconnect at least two ground contacts.

13. An electrical connector comprising:

a housing having a first end and a second end, the housing having a mating slot formed between the first and second ends, the mating slot being configured to receive a mating connector having contact pads on a first side and contact pads on a second side;

a contact array received in the housing, the contact array including a first set of ground contacts and signal contacts arranged at the first end, the contact array including a second set of ground contacts and signal contacts arranged at the second end, the ground contacts including attachment portions thereon, the ground and signal contacts of the first set configured to engage the contact pads on the first side of the mating connector, the ground and signal contacts of the second set configured to engage the contact pads on the second side of the mating connector;

at least one lossy ground absorber received in the housing and extending at least partially between the first and second ends, each lossy ground absorber interconnecting at least one of the ground contacts of the first set and at least one of the ground contacts of the second set, each lossy ground absorber including a first absorber end having a first opening and a second absorber end having a second opening, the first opening receiving the attachment portion of the corresponding ground contact of the first set and the second opening receiving the attachment portion of the corresponding ground contact of the second set.

14. The electrical connector of claim 13, wherein the housing and the at least one lossy ground absorber are co-molded.

15. The electrical connector of claim 13, wherein the housing is manufactured from a low loss dielectric material and the at least one lossy ground absorber is manufactured from lossy material having conductive particles in a dielectric binder material, the lossy ground absorber absorbing electrical resonance propagating through the housing.

16. The electrical connector of claim 13, wherein the ground contacts are arranged in a row with a pair of signal contacts between each of the ground contacts, the at least one lossy ground absorber spanning between the ground contacts across the pair of signal contacts.

17. An electrical connector comprising:

a housing having a first end and a second end, the housing having a front end and a rear end, the housing having a first side and a second side between the first and second ends, the housing having a mating slot open at the front end and positioned between the first and second ends and between the first and second sides, the mating slot being configured to receive a mating connector having contact pads;

a contact array received in the housing, the contact array including ground contacts and signal contacts interspersed along a contact row between the mating slot and the first end, the ground contacts including attachment portions thereon;

a lossy ground absorber received in the housing at the first end, the lossy ground absorber extending along the contact row across at least two signal contacts and at least two ground contacts, the lossy ground absorber including at least two openings receiving the attachment portions of the corresponding ground contacts, the lossy ground absorber interconnecting at least two of the ground contacts.

18. The electrical connector of claim 17, wherein the housing is manufactured from a low loss dielectric material and the at least one lossy ground absorber is manufactured from lossy material having conductive particles in a dielectric binder material, the lossy ground absorber absorbing electrical resonance propagating through the housing.

19. The electrical connector of claim 17, wherein the contact array includes ground contacts and signal contacts interspersed along a second contact row between the mating slot and the second end, the lossy ground absorber interconnecting at least one of the ground contacts in the contact row and at least one of the ground contacts in the second contact row.

20. The electrical connector of claim 17, wherein the at least one lossy ground absorber extends widthwise between a front end and a rear end of the housing to interconnect at least one ground contact at the front end with at least one ground contact at the rear end.

* * * * *